US009134021B2

(12) United States Patent
Domoto et al.

(10) Patent No.: US 9,134,021 B2
(45) Date of Patent: Sep. 15, 2015

(54) BOILER STRUCTURE

(75) Inventors: Kazuhiro Domoto, Nagasaki (JP); Hiroshi Suganuma, Nagasaki (JP); Yuichi Kanemaki, Aichi (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 487 days.

(21) Appl. No.: 13/058,443

(22) PCT Filed: Jun. 4, 2009

(86) PCT No.: PCT/JP2009/060228

§ 371 (c)(1),
(2), (4) Date: Feb. 10, 2011

(87) PCT Pub. No.: WO2010/064462

PCT Pub. Date: Jun. 10, 2010

(65) Prior Publication Data

US 2011/0132281 A1 Jun. 9, 2011

(30) Foreign Application Priority Data

Dec. 3, 2008 (JP) ..... 2008-308471

(51) Int. Cl.
*F22B 37/10* (2006.01)
*F22B 37/12* (2006.01)

(52) U.S. Cl.
CPC ..... *F22B 37/10* (2013.01); *F22B 37/12* (2013.01)

(58) Field of Classification Search
USPC ..... 122/235.12, 235.14, 235.23, 235.11, 122/332–349
See application file for complete search history.

(56) References Cited

U.S. PATENT DOCUMENTS 3,511,217 A * 5/1970 Lorenzini et al. ..... 122/406.1
3,662,716 A * 5/1972 Stevens ..... 122/6 A (Continued)

FOREIGN PATENT DOCUMENTS

CN 1240020 A 12/1999
CN 1902438 A 1/2007

(Continued)

OTHER PUBLICATIONS

Chinese Office Action dated Nov. 30, 2012, issued in corresponding Chinese patent application No. 200980133580.9, w/ English translation.

(Continued)

*Primary Examiner* — Steven B McAllister
*Assistant Examiner* — Ko-Wei Lin
(74) *Attorney, Agent, or Firm* — Westerman, Hattori, Daniels & Adrian, LLP

(57) ABSTRACT

Provided is a boiler structure with which, by reducing the pressure drop in boiler evaporation tubes correspondingly to the heat flux, which varies in accordance with the distance in the boiler height direction, it is possible to reduce auxiliary power for a water feed pump and so forth, in addition to improving the flow stability and the natural circulation characteristics. The boiler structure includes a number of boiler evaporation tubes that are arranged on a wall surface of a furnace and that form a furnace wall, water pumped into the boiler evaporation tubes being heated in the furnace during flowing inside the tubes to produce steam, wherein the boiler evaporation tubes are formed by connecting tubes of a plurality of types, in which tube wall thicknesses are adjusted on the basis of furnace heat flux such that the higher the furnace heat flux in a region is, the smaller the tube inner diameter becomes.

3 Claims, 2 Drawing Sheets

(56) References Cited

U.S. PATENT DOCUMENTS

| | | | | | |
|---|---|---|---|---|---|
| 4,257,358 | A | * | 3/1981 | Watanabe | 122/235.11 |
| 4,368,694 | A | * | 1/1983 | Ward et al. | 122/504 |
| 5,390,631 | A | * | 2/1995 | Albrecht | 122/235.12 |
| 5,701,850 | A | * | 12/1997 | Kohler et al. | 122/235.23 |
| 5,755,188 | A | * | 5/1998 | Phelps | 122/511 |
| 6,007,325 | A | * | 12/1999 | Loftus et al. | 431/8 |
| 6,715,450 | B1 | * | 4/2004 | Wittchow | 122/1 B |
| 7,516,719 | B2 | * | 4/2009 | Kral et al. | 122/6 A |

FOREIGN PATENT DOCUMENTS

| | | | | | |
|---|---|---|---|---|---|
| JP | 46-100270 | U | | 11/1972 | |
| JP | 47-28304 | A | | 11/1972 | |
| JP | 62-070204 | U | | 5/1987 | |
| JP | 62070204 | U | * | 5/1987 | F22B 37/10 |
| JP | 6-137501 | A | | 5/1994 | |
| JP | 8-500426 | A | | 1/1996 | |

OTHER PUBLICATIONS

Japanese Decision to Grant a Patent dated Jan. 8, 2013, issued in corresponding Japanese patent application No. 2008-308471.

J. Franke et al., "Evaporator Designs the Benson Boilers, State of the Art and Latest Development Trends", VGB Kraftwerkstechnik 73 (1993), No. 4; pp. 307-315, cited in spec.

International Search Report of PCT/JP2009/060228, date of mailing Aug. 18, 2009.

Chinese Notice of Allowance dated Dec. 16, 2014, issued in corresponding CN Application No. 200980133580.9 (2 pages).

Chinese Office Action dated Jan. 3, 2014, issued in corresponding Chinese Patent Application No. 200980133580.9, w/English translation, (16 pages).

Chen Xinghua, "Hydraulics pump and blower", Beijing hydraulic and electric engineering press, (1987), pp. 88-90, cited in Chinese Office Action dated Jan. 3, 2014, issued in corresponding Chinese Patent Application No. 200980133580.9.

* cited by examiner

BOILER STRUCTURE

TECHNICAL FIELD

The present invention relates to a boiler structure that is provided with a boiler evaporation tube (furnace wall), like, for example, a supercritical variable pressure once-through boiler.

BACKGROUND ART

In a conventional supercritical variable pressure once-through boiler, water is fed into a number of boiler evaporation tubes arranged on a wall surface of a furnace, and this water is heated in the furnace, thereby producing steam. In this case, the boiler evaporation tubes are arranged in the vertical direction in the furnace so that the water pumped into the boiler evaporation tubes from one end thereof flows in one direction without circulating therein and turns into steam. In other words, the water pumped in from the bottom part of the furnace turns into steam during the course of flowing upwards towards the top of the furnace wall.

The tube inner diameter of the above-described boiler evaporation tubes is selected on the basis of the region in which the heat flux in the furnace is the highest. Specifically, as shown in FIG. 1 for example, the tube inner diameter is selected on the basis of the heat flux in the region where a burner 3, through which fuel and air are supplied into a furnace 2 of a boiler 1, is disposed.

On the other hand, the inner diameter of the boiler evaporation tubes should be decreased to increase the velocity of the fluid flowing inside in order to ensure the heat transfer characteristics, and the inner diameter should be increased to reduce the velocity of the fluid flowing inside in order to reduce the pressure drop in the furnace.

However, with a boiler structure in the present situation, even though there is a variation of the heat flux in the furnace 2, the velocity and the tube wall thickness are set so as to ensure sufficient durability even in the region where the heat flux in the furnace is the highest; the tube inner diameter of all boiler evaporation tubes is generally determined so as to become uniform, depending on the velocity and the tube wall thickness. Therefore, regarding only the pressure drop caused in the boiler evaporation tubes of the furnace 2, because it is difficult to set a suitable tube inner diameter, it has not been possible to adjust the pressure drop to the desirable value and it had to be left uncontrolled.

In addition, with the above-described boiler evaporation tubes, it is known that if the overall velocity of the tubes is controlled to be low by uniformly setting the tube inner diameter large, the frictional loss component of the pressure drop becomes low, and the flow stability and the natural circulation characteristics are effectively improved (for example, see Non Patent Literature 1).

CITATION LIST

Non Patent Literature

{NPL 1}
Evaporator Designs for Benson Boilers, State of the Art and Latest Development Trends, By J. Franke, W. Kohler and E. Wittchow (VGB Kraftwerkstechnik 73 (1993), Number 4)

SUMMARY OF INVENTION

Technical Problem

With the above-described conventional technique, because optimization of the tube inner diameter and management of the pressure drop in the boiler evaporation tubes are difficult, auxiliary power, such as water feed pumping power and so forth, is increased due to the increase in pressure drop in the boiler evaporation tubes. Further improvement is still possible because such an increase of the auxiliary power causes an increase in the size of the boiler and also causes an increase in the running costs and so forth.

In addition, because optimization of the tube inner diameter and management of the pressure drop of the boiler evaporation tubes are difficult, the velocity is increased when the water inside the tube is expanded due to the temperature rise, thereby increasing the frictional loss component of the pressure drop. Further improvement is still possible because such an increase in the frictional loss component deteriorates the flow stability.

Furthermore, in the case where the tube inner diameter is uniformly set large so as to keep the overall velocity of the tubes low, although the frictional loss component of the pressure drop is reduced to effectively improve the flow stability and the natural circulation characteristics, considering the actual situation related to the supercritical pressure once-through boiler and so forth in which the heat flux varies depending on the distance in the boiler height direction, there is a limit to the uniform increase in the tube inner diameter. In other words, as in the above-described conventional technique, the tube inner diameter has to be selected on the basis of the region where the heat flux in the furnace is the highest.

The present invention has been conceived in light of the circumstances described above, and an object thereof is to provide a boiler structure that is capable of reducing the pressure drop of the boiler evaporation tubes (furnace wall) while maintaining health of the boiler evaporation tubes by selecting the tube wall thickness on the basis of the heat flux, which varies depending on the distance in boiler height direction, and, in addition to the reduction of the auxiliary power for the water feed pump and so forth, that is capable of improving the flow stability and the natural circulation characteristics.

Solution to Problem

In order to solve the problems described above, the present invention employs the following solutions.

The boiler structure according to one aspect of the present invention includes a number of boiler evaporation tubes that are arranged on a wall surface of a furnace and that form a furnace wall, water pumped into the boiler evaporation tubes being heated in the furnace while flowing inside the tubes to produce steam, wherein the boiler evaporation tubes are formed by connecting tubes of a plurality of types, in which tube wall thicknesses thereof are adjusted on the basis of the furnace heat flux such that the higher the furnace heat flux in a region is, the smaller the tube inner diameter becomes.

According to such a boiler structure, since the boiler evaporation tubes forming the furnace wall are formed by connecting tubes of a plurality of types, in which the tube wall thicknesses are adjusted on the basis of the furnace heat flux such that the higher the furnace heat flux in a region is, the smaller the tube inner diameter becomes, it is possible to optimize the tube inner diameter depending on the heat flux. Thus, in the region where the furnace heat flux is low, the tube inner diameter becomes large, and it is possible to reduce the pressure drop from the inlet to the outlet of the boiler evaporation tubes.

In the above aspect, it is preferable that the boiler evaporation tubes are appropriately used by using a rifled tube in a region with a high furnace heat flux and by using a smooth tube in a region with a low furnace heat flux, thereby being capable of effectively reducing the pressure drop of the boiler evaporation tubes.

Advantageous Effects Of Invention

According to the above-described present invention, since the tube wall thickness of the boiler evaporation tubes forming the furnace wall is adjusted to change the tube inner diameter in a stepwise manner correspondingly to the heat flux, which varies depending on the distance in the boiler height direction, it is possible to reduce the pressure drop by increasing the tube inner diameter in the region with the low heat flux and to reduce the auxiliary power for a water feed pump and so forth. In addition, as a result of the reduction of the pressure drop as described above, a notable advantage can be obtained in that the flow stability and the natural circulation characteristics of water flowing through the furnace wall are improved.

DESCRIPTION OF EMBODIMENTS

An embodiment of a boiler structure according to the present invention will be described below based on the drawings.

Figure 1:
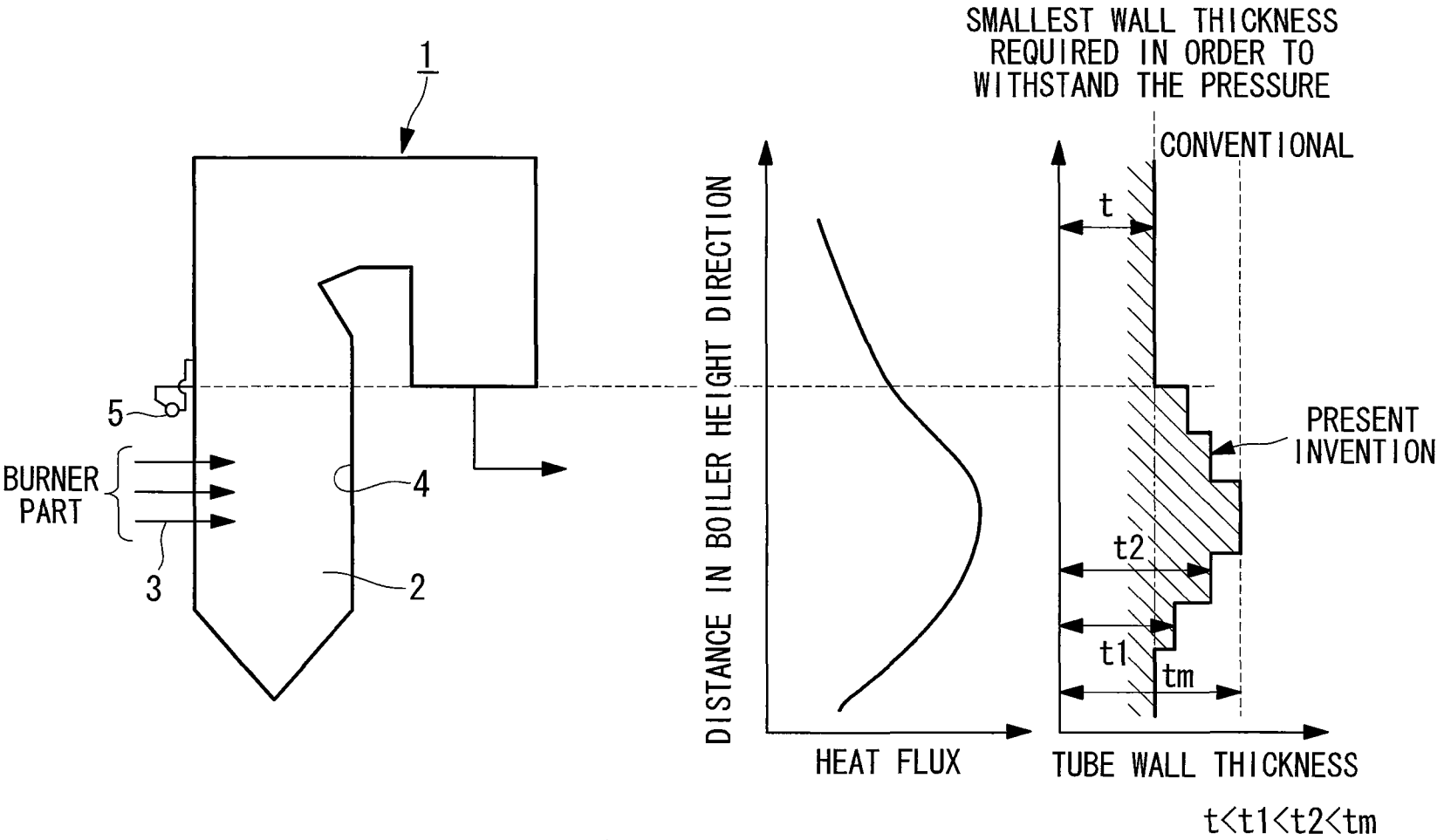
FIG. 1 is an explanatory diagram showing one embodiment of a boiler structure according to the present invention.
Figure 2:
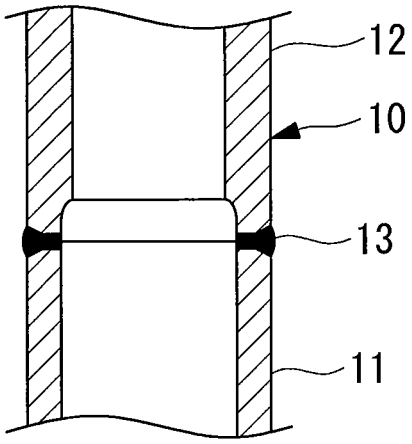
FIG. 2 is a sectional view showing an example of a connection structure in which tube materials having different inner diameters but the same outer diameter are connected.
Figure 3:
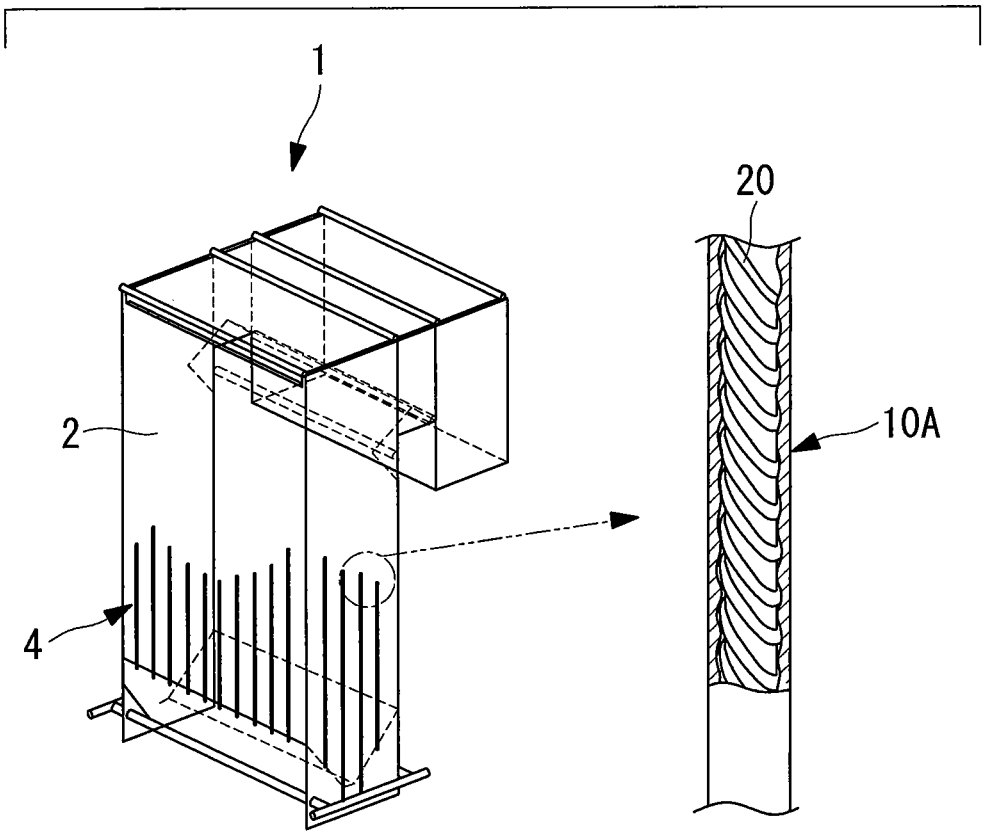
FIG. 3 is a diagram showing a rifled tube as a modification of a boiler structure according to the present invention.

In the embodiment shown in FIGS. 1 to 3, a boiler 1 is a supercritical variable pressure once-through boiler configured so that a furnace wall 4 is formed by a number of boiler evaporation tubes 10 that are arranged on a wall surface of a furnace 2, and, when the water pumped into the boiler evaporation tubes 10 flows inside the tubes, the water is heated inside the furnace 2 to produce steam. In the illustrated boiler 1, the furnace 2 has a rectangular horizontal cross-section in which four furnace walls 4 are formed on the front, rear, left, and right surfaces, respectively.

An intermediate header 5 shown in FIG. 1 is a part in which, above a burner part where a burner 3 is arranged, the boiler evaporation tubes 10 are first brought together to the non-heated exterior of the furnace and are distributed again towards the ceiling wall side of the upper part in the furnace.

Therefore, water supplied from outside the furnace 2 to the boiler evaporation tubes 10 that form the furnace wall 4 of the boiler 1 flows upward inside the boiler evaporation tubes 10 in the direction from the bottom to the top part of the furnace 2 and turns into steam by being heated during the course of flowing upward. This steam flows out of the furnace 2 above the burner part, and after being collected from each of the boiler evaporation tubes 10 in the intermediate header 5, the steam is distributed again and flows towards the ceiling wall of the upper part in the furnace. The steam thus-guided to the ceiling wall in this way is further heated, thereby reaching a super heated temperature. The above-described water is pumped by a water feed pump, which is not illustrated in the drawing, and is forced into the boiler evaporation tubes 10 from the bottom part in the furnace 2.

The above-described boiler evaporation tubes 10 are formed by connecting tubes of several types, the tube wall thicknesses of which have been adjusted depending on the furnace heat flux such that the higher the furnace heat flux in a region is, the smaller the tube inner diameter becomes. In other words, in the furnace 2 of the boiler 1, as shown in FIG. 1 for example, because the heat flux in the furnace 2 varies in accordance with the distance in the boiler height direction, the tube wall thicknesses of the boiler evaporation tubes 10 are adjusted depending on the magnitude of the furnace heat flux, and the tube inner diameters are changed in a number of steps. At this time, when the inner diameters of the boiler evaporation tubes 10 are determined, it is necessary to consider ensuring the required velocity by not increasing the tube inner diameter excessively in order to ensure the required heat transfer characteristics.

The boiler evaporation tube 10 in this case is one continuous tube having a required length that is formed by welding a plurality of tube materials having the same outer diameter but different inner diameters (wall thicknesses).

Specifically, in the region in which the furnace heat flux is approximately the same level as the boiler part where the furnace heat flux is the highest, the tube inner thickness of the boiler evaporation tube 10 is set to be the largest, and as a result, the tube material having the smallest tube inner diameter is used. The tube wall thickness in this case is a value set so that the boiler evaporation tubes 10 are sufficiently durable without being damaged by the furnace heat flux within the predetermined operation period, and therefore, it is a value larger than the smallest tube wall thickness t required in order to withstand the pressure. In other words, provided that the conditions related to the boiler 1 are the same, in the region in which the tube wall thickness becomes the largest, the tube wall thickness is the same value as the tube wall thickness tm in the related art.

Next, in the regions that are vertically adjacent to the region with the highest furnace heat flux, the tube wall thickness is set to the tube wall thickness t2 that is slightly smaller than the largest tube wall thickness tm. This tube wall thickness t2 is a value at which the wall thickness is reduced corresponding to the decrease of the furnace heat flux, and the tube wall thickness t2 is also a value larger than the smallest tube wall thickness t required in order to withstand the pressure.

Similarly, the tube wall thickness is set to be decreased in a stepwise manner, in the order tm, t2, and t1, as the distance from the region with the highest furnace heat flux increases, and eventually, the tube wall thickness is set to the smallest tube wall thickness t required in order to withstand the pressure. In other words, in the illustrated structure example, the tube wall thickness of the boiler evaporation tube 10 is increased, from the bottom part of the furnace 2, in the order t, t1, t2, and tm, and thereafter, is decreased in the order t2, t1, and t. In other words, the tube inner diameter of the boiler evaporation tube 10 is sequentially decreased from the bottom part of the furnace 2 to the burner part in a stepwise manner, and thereafter, is increased in a stepwise manner from the burner part where the tube inner diameter is the smallest.

In the above-described embodiment, although four tube materials having the same outer diameter but having tube wall thicknesses in four steps, t, tl, t2, and tm are connected, the tube materials may be connected in five or more steps, or in three or less steps, depending on the conditions of the boiler 1. In addition, in the above-described embodiment, although the wall thickness of the boiler evaporation tube 10 is changed in a stepwise manner in the furnace 2 that is subjected to the furnace heat flux, the wall thickness may also be changed and may be made thinner for non-heated portions in the same manner.

FIG. 2 is a sectional view showing a connection structure example for the boiler evaporation tube 10 that is formed by connecting the tube materials having equal outer diameter but different tube inner diameters.

The boiler evaporation tubes 10 illustrated show a structure in which two tube materials having equal outer diameter are connected by butt welding. In other words, a tube material 11 having a large inner diameter (small wall thickness) and a tube material 12 having a small inner diameter (large wall thickness) are subjected to butt welding at a welding part 13 after the inner surface of the end part of the tube material 12 side, which has a small inner diameter (large wall thickness), is processed to have the same inner diameter and wall thickness as the tube material 11. In this case, as the tube material, although smooth tubes are connected to each other, this connection structure can be applied to connection with a rifled tube 20, which is described below.

The boiler evaporation tube 10, which is formed by connecting the tube materials in this way, essentially has no steps that would act as obstacles to the flow at the connection part between the tube materials 11 and 12 having the different tube inner diameters, and furthermore, because the difference between the inner diameters of the tube materials 11 and 12 is as small as a few millimeters, there is little adverse effect in terms of the pressure drop and so forth of the furnace wall 4.

According to such a boiler structure, the boiler evaporation tubes 10 forming the furnace wall 4 are formed by connecting tubes of a plurality of types that have the tube wall thickness adjusted depending on the furnace heat flux such that the higher the furnace heat flux in a region is, the smaller the tube inner diameter becomes, in a stepwise manner, and therefore, it is possible to optimize the tube inner diameter in accordance with the heat flux. Therefore, in the region with a low furnace heat flux, the tube inner diameter can be made larger, and therefore, it is possible to reduce the pressure drop from the inlet to the outlet of the boiler evaporation tubes 10, and to reduce the auxiliary power for the water feed pump and so forth.

As a result, with the boiler evaporation tubes 10, because the region (the length of the tube) with the large inner diameter is increased compared with the conventional structure in which the inner diameter is uniform over the entire length, the flow stability of the water and steam flowing inside the tubes is improved. In other words, even if the fluid is expanded due to the increase in temperature with the increased furnace heat flux, since the averaged value of the tube inner diameter of the boiler evaporation tubes 10 is large, the variation in the velocity is low, and therefore, it is possible to form a stable flow by controlling the range of fluctuation of the frictional loss component responsible for the pressure drop.

In addition, the increase of the region (the length of the tube) with the large inner diameter in the boiler evaporation tubes 10 can improve the natural circulation characteristics of the water and steam in the boiler evaporation tubes 10, in addition to the improving the flow stability, as described above.

In other words, since the averaged value of the tube inner diameter of the boiler evaporation tubes 10 is large, the proportion of the frictional loss component responsible for the pressure drop is low, and so, even if the furnace heat flux is increased, the variation in the velocity is low. Consequently, since the range of fluctuation of the frictional loss component is controlled and the static component of the pressure drop is further reduced due to the expansion of the fluid, the overall pressure drop itself, which is the total value of both of these components, also becomes low. Therefore, since the velocity of the fluid flowing inside the boiler evaporation tubes 10 is increased in accordance with the decrease of the pressure drop, the natural circulation characteristics should be improved.

In addition, as a modification of the above-described boiler evaporation tubes 10, as shown in FIG. 3 for example, the boiler evaporation tubes 10 may be appropriately used by using the rifled tubes 20 in the region with a high furnace heat flux, and by using the smooth tubes, which have normal inner wall surface, in the region with a low furnace heat flux.

In other words, for the region in the vicinity of the burner part in the furnace 2 where the furnace heat flux is high, the rifled tubes 20 in which a helical groove is formed on the tube inner circumferential surface are used. These rifled tubes 20 are characterized in that, although they are advantageous in terms of the heat transfer characteristics, on the other hand, the frictional loss is large.

Therefore, with the boiler evaporation tubes 10A in this modification, by using the rifled tubes 20 with the smooth tubes connected thereto, the rifled tubes 20 that are arranged in the region with the highest furnace heat flux are capable of causing the heat to be absorbed into the fluid that is flowing inside the tubes, and the smooth tubes with a low frictional loss that are arranged in the other regions are capable of reducing the overall pressure drop. By doing so, since the pressure drop in the furnace wall 4 is reduced, not only is it possible to reduce the auxiliary power for the water feed pump and so forth, but it is also possible to effectively improve the flow stability and natural circulation characteristics.

In addition, with such rifled tubes 20, a combination with the above-described embodiment, such as arranging the rifled tubes 20 having an increased tube wall thickness in the region with the highest furnace heat flux, is of course also possible.

As described above, according to the boiler structure of the present invention, since the tube wall thicknesses of the boiler evaporation tubes 10 forming the furnace wall 4 are adjusted to change the tube inner diameters in a stepwise manner so as to be adapted to the heat flux, which varies depending on the distance in the boiler height direction, as well as being able to ensure the required heat transfer characteristics, it is also possible to reduce the pressure drop by increasing the tube inner diameter in the region with a low heat flux, to make the size of the auxiliary machines etc., such as the water feed pump and so forth, smaller, and to reduce the auxiliary power required for operation of the auxiliary machines etc. Therefore, it is possible to reduce the size of the boiler and to reduce the running costs.

In addition, by reducing the above-described pressure drop, it is also possible to improve the flow stability and natural circulation characteristics of the water flowing through the furnace wall.

In addition, by partly using the rifled tubes 20, in combination with the smooth tubes, in the region with a high furnace heat flux, it is possible to reduce the pressure drop in the furnace 2, thus affording similar operational advantages.

The present invention is not restricted to the above-described embodiment. Suitable modifications can be made so long as they do not depart from the spirit thereof.

REFERENCE SIGNS LIST

1 boiler
2 furnace
3 burner
4 furnace wall
5 intermediate header
10, 10A boiler evaporation tubes
20 rifled tube

The invention claimed is:

1. A boiler structure comprising:

a number of boiler evaporation tubes that are arranged vertically on a wall surface that form a furnace wall of a furnace, the boiler evaporation tubes being heated in the furnace to produce steam from water flowing inside the tubes;

wherein the vertically arranged boiler evaporation tubes are formed by connecting a plurality of straight tubes each having same outer diameter, inner diameters of the straight tubes in a burner part of the furnace are set at varying wall thickness of the straight tubes such that the inner diameters are set according to the furnace heat flux experienced by the straight tubes in the burner part in such a way that in a region where the furnace heat flux is highest, the inner diameter is set to be the smallest, and the inner diameters in the burner part are set in a stepwise manner according to the furnace heat flux that varies in accordance with a distance in a boiler height direction of the burner part, wherein at least three different inner diameters of the boiler evaporation tubes are set to correspond to at least three steps from the bottom part of the furnace to the burner part of the furnace and at least three different inner diameters of the boiler evaporation tubes are set to correspond to at least three steps above the burner part of the furnace, the three different inner diameters of the boiler evaporation tubes corresponding to said at least three steps from the bottom part to the burner part are same as the respective three inner diameters of the boiler evaporation tubes corresponding to said at least three steps above the burner part.

2. A boiler structure according to claim 1, wherein the boiler evaporation tubes are provided with a rifled tube in a region with a high furnace heat flux and a smooth tube in a region with a low furnace heat flux.

3. A boiler structure according to claim 1, wherein:

the tube inner diameter is smallest at the burner part of the boiler structure.

* * * * *